US006336824B1

(12) United States Patent
Sorig

(10) Patent No.: US 6,336,824 B1
(45) Date of Patent: Jan. 8, 2002

(54) SCREWLESS JUNCTION BOX CONNECTION

(75) Inventor: Ludger Sorig, Ascheberg (DE)

(73) Assignee: Weidmüller Interface GmbH & Co., Detmold (DE)

( * ) Notice: Subject to any disclaimer, the term of this patent is extended or adjusted under 35 U.S.C. 154(b) by 0 days.

(21) Appl. No.: 09/712,217

(22) Filed: Nov. 15, 2000

(30) Foreign Application Priority Data

Nov. 17, 1999 (DE) ..... 299 20 231 U

(51) Int. Cl.[7] ..... H01R 4/24
(52) U.S. Cl. ..... 439/441; 439/440; 439/395
(58) Field of Search ..... 439/440, 441, 439/395, 717

(56) References Cited

U.S. PATENT DOCUMENTS

| | | | | |
|---|---|---|---|---|
| 5,626,488 A | * | 5/1997 | Albeck et al. | 439/395 |
| 5,993,245 A | * | 11/1999 | Osada | 439/449 |
| 6,074,241 A | * | 6/2000 | Patel et al. | 439/441 |

FOREIGN PATENT DOCUMENTS

| | | |
|---|---|---|
| DE | 1 876 071 | 7/1963 |
| DE | 12 29 609 | 12/1966 |
| DE | 1 989 885 | 7/1968 |
| DE | 19 98 538 | 8/1968 |
| DE | 27 06 988 | 8/1978 |
| DE | 78 32 646 UI | 2/1979 |
| DE | 82 28 403.2 | 1/1983 |
| DE | 43 32 969 C1 | 7/1994 |
| DE | 38 30 442 C2 | 10/1996 |
| EP | 08 98 325 A1 | 8/1997 |
| FR | 1 052 067 | 1/1954 |

* cited by examiner

*Primary Examiner*—Gary Paumen
*Assistant Examiner*—Alexander Gilman
(74) *Attorney, Agent, or Firm*—Lawrence E. Laubscher, Sr.

(57) ABSTRACT

A screwless junction box or terminal connector includes a housing containing a chamber in which are mounted an electrical contact and a clamping spring, the clamping spring being operable to bias a conductor toward electrical engagement with the contact, characterized by the provision of a slide member that is manually operable from a released position toward an inserted position, thereby to displace the clamping leg toward a disengaged position relative to the electrical contact, whereby the conductor may be inserted directly within the housing chamber. A restoring spring biases the slide member toward its released return position.

12 Claims, 4 Drawing Sheets

FIG. 4
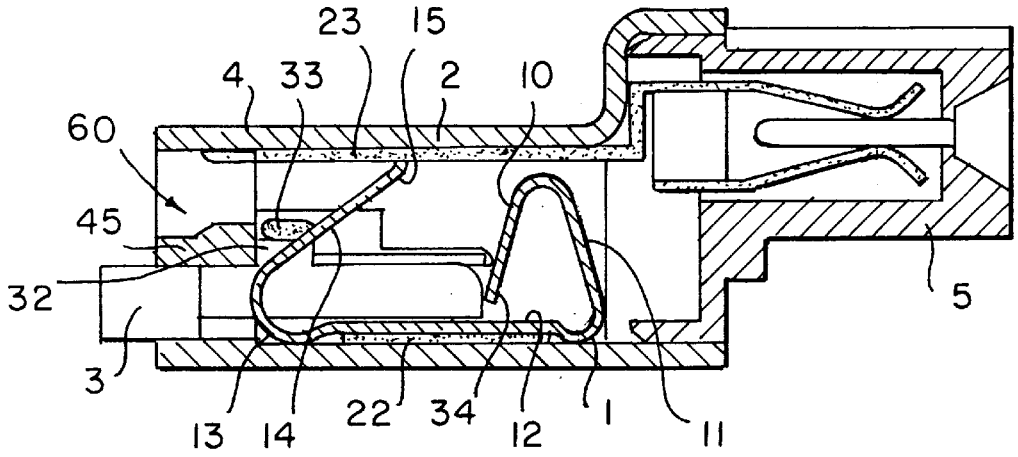
FIG. 5
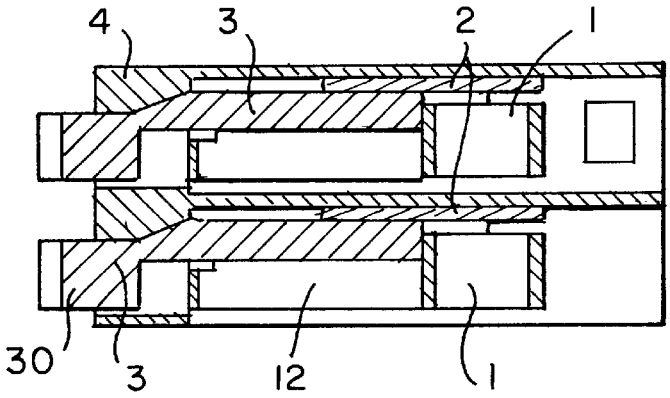
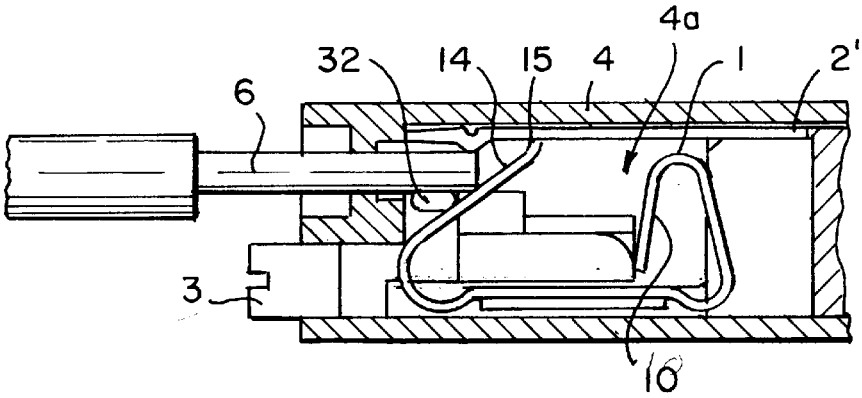
FIG.6

SCREWLESS JUNCTION BOX CONNECTION

BACKGROUND OF THE INVENTION

1. Field of the Invention

This invention relates to a screwless terminal for connecting a conductor with an electrical contact by means of a clamping spring that is operable between clamping engaged and disengaged positions by a manually operable slide member.

2. Brief Description of the Prior Art

The German patent No. DE 43 32 969 C1 discloses a screwless terminal wherein a conductor can be connected with a connection terminal. For this purpose, there is provided a resilient member that moves the connection terminal into a receiving position in order to insert the conductor into an opening of the connection terminal. In order firmly to clamp the conductor, one turns the tension member so that an eccentric segment on the tension member will release the connection terminal, whereby the conductor will be firmly retained on the connection terminal by the force of the spring. To release the conductor, the tension member must be turned again until the eccentric segment engages the connection terminal and until the clamping force of the connection terminal is overcome. This design of the connection terminal requires an operating tool, both for the purpose of firmly clamping and for removing an electrical conductor. Furthermore, the known connection terminal has an expensive construction because it is composed of many individual parts.

In the German patent No. DE 38 34 442 C2, a clamping device is disclosed wherein, in addition to the introduction opening for an electrical conductor, there is provided a slide device for the purpose of firmly clamping the conductor. To this end, there is provided between the electrical conductor and the slide a leaf spring that, upon introduction of the slide device, is compressed and thus firmly clamps the conductor. To separate the clamping connection, the slide is pulled out so that the leaf spring will spread and release the conductor. Of course, this clamping device offers the advantage that no tool is required to work the slide but, on the other hand, to remove the conductor, the slide must be pulled out and must then again be pushed into the housing for clamping action. The known clamping device furthermore entails the disadvantage that the leaf spring must be positioned rather laboriously in the housing and that the large number of individual parts makes the production of the clamping device laborious and expensive.

The present invention was developed to provide a connection terminal on which the conductor can be clamped in a simple manner without a tool and then can be removed again. Furthermore, the connection terminal should consist of a few individual parts and it should thus be possible to make it at reasonable cost.

SUMMARY OF THE INVENTION

Accordingly, a primary object of the present invention is to provide a screwless terminal connection that includes an electrical contact and a clamping spring arranged in a housing chamber that contains an opening for receiving the bare end of the conductor, a slide member being provided that is manually insertable against the restoring force of a spring to displace a resilient clamping leg to an inoperable position, whereby the conductor may be inserted into, or removed from, the connector chamber.

According to a more specific object of the invention, the slide element is movable from an initial released position toward an inserted position to engage or disengage the clamping connection between the conductor and the clamping spring. After activation, the slide element is returned to its initial position by means of a restoring spring. Thus, the slide element, as a rule, need be operated only for the unlocking process. Only in exceptional cases with thin, single-wire and fine-wire conductors must the slide element be operated in order to prevent damage to the fine-lead conductor as it is pushed in. After unlocking, the slide element then automatically returns to the starting position in which the conductor is firmly kept in place by the clamping spring. In the routine case, the operator of the connecting terminal always knows that the slide element is in the locked starting position and need be operated only for unlocking purposes. This offers the advantage that its clamping leg of the clamping spring is mechanically uncoupled from the resetting leg and thus decisively contributes to the safety of the "conductor clamping" and activation functions.

According to another object of the invention, the slide element can be shifted into the starting position by a part of the clamping spring. This design offers the advantage that the number of parts is reduced to a minimum because the clamping spring, on the one hand, takes over the function of the conductor connection and, on the other hand, does the job of fixing the activation element. The slide element can preferably be shifted along its longitudinal axis from the starting position into the unlocking position. On the slide element, there is preferably provided a catch that takes care of the activation of the spring leg earmarked for conductor connection. The slide element is preferably retained in the housing in a manner that it cannot be lost so that it cannot be lost inadvertently.

According to a preferred embodiment of the invention, the clamping spring has a spring leg that rests against the end of the slide element which is arranged in the housing. In this way, one can in a simple manner fix the slide element. For a particularly compact design, the clamping spring can between the clamping leg and the spring leg have a section of diminished width on which the slide element is run through. In that way, one can make the connection clamp with only minimal width.

Preferably, the slide element can be latched or arrested in the unlocked or released position. This enables the user to provide an open clamping point in order, for example, to insert a fine-lead conductor into the connection terminal which otherwise could be damaged by the clamping spring. A simple mechanical design of the latch device includes a latch element that engages a retaining recess contained in the connector housing. the latch member can be engaged and disengaged from the locking recess by simple rotation of a rotatably mounted end portion of the slide member.

BRIEF DESCRIPTION OF THE DRAWINGS

Other objects and advantages of the invention will become apparent from a study of the following specification when viewed in the light of the accompanying drawings, in which:

FIG. 4 is a longitudinal sectional view of the connector of FIG. 1 in the initial disconnected condition;

FIG. 5 is a top sectional view of a multi-contact embodiment of the invention;

FIG. 6 illustrates a modification of the embodiment of FIG. 1 prior to the insertion of the conductor into the connector housing;

DETAILED DESCRIPTION

Figure 1:
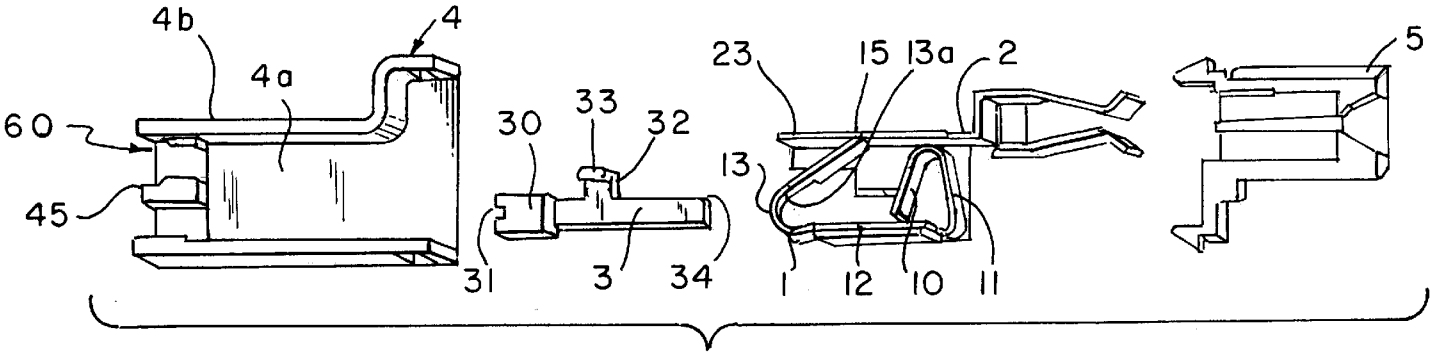
FIG. 1 is an exploded perspective view of the screwless terminal connector of the present invention.

Referring first more particularly to FIGS. 1–4, the screwless terminal connector of the present invention includes a clamping spring 1 that is connected with an electrical contact 2 for arrangement within a longitudinally extending chamber 4*a* contained in the connector housing 4, which is formed of electrically-insulating synthetic plastic material. A slide actuating member 3 is slidably mounted within the left hand end of the housing chamber 4*a*, and a second housing member 5 formed from suitable non-conductive electric insulating material is removably connected by snap fit means with the right hand end of the housing chamber 4*a*.

The clamping spring 1 is mounted between a pair of parallel vertically spaced flange portions 22 and 23 of the contact member 2. The contact member 2 includes a pair of resilient female contacts 21 that extend within a corresponding chamber contained in the second housing element 5. The clamping spring 1 includes a horizontal base portion 12 that is supported by the contact flange 22. At its left hand end, the clamping spring is provided with a clamping leg 14 that is connected with the left hand end of the base portion 12 by a connecting bridge portion 13. The clamping leg 4 is arranged at an acute angle relative to the clamping spring base portion 12, and is resiliently biased outwardly from the base portion 12 toward engagement with the upper contact flange 23. At its right hand end, the base portion 12 is connected with one end of a generally orthogonally arranged intermediate portion 11 that is connected at its upper end with a reversely bent restoring leg 10, which is arranged at an acute angle with the support leg 11.

Figure 3:
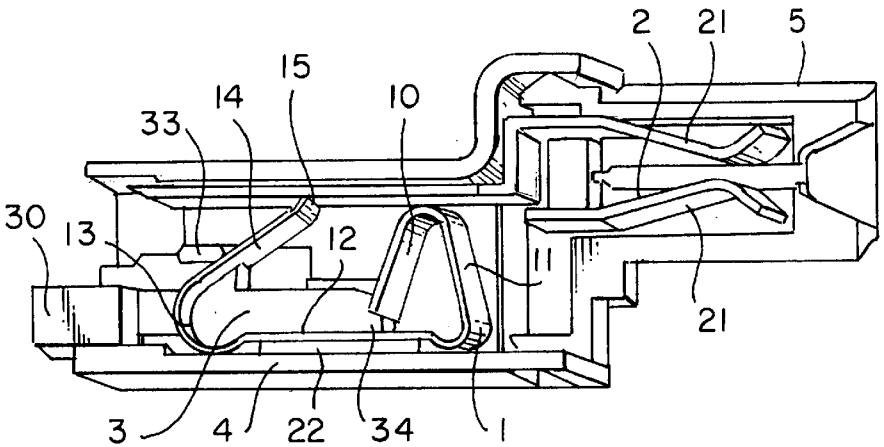
FIG. 3 is a perspective view of the assembled screwless connector with the slide member in the released position.

The slide member 3 includes at its left hand end an enlarged head portion 30 containing at its left hand extremity a slot 31 for receiving an linear force-applying tool, as will be described below. At its right hand end, the slide element has a nose portion 34 that is in engagement with the resilient restoring leg 10 of the clamping spring 1, as best shown in FIG. 3. The slide member includes a lateral projecting portion 33 that is adapted to engage the clamping leg 14 of the spring member 1.

Figure 2:
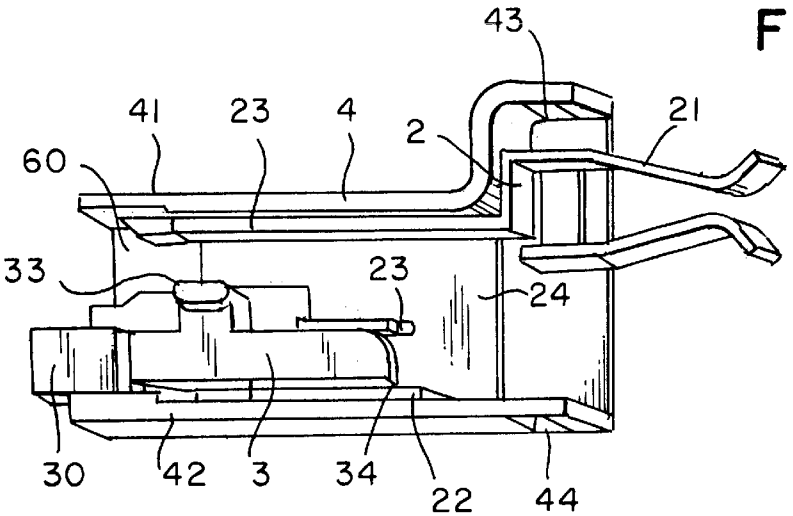
FIG. 2 is a partially assembled view of certain of the components of FIG. 1.

In order to prevent removal of the sliding element 3 from the chamber 4*a* of the housing 4, a stop 45 is provided on the housing wall that engages the vertical support portion 32 of the lateral projection 33, thereby to limit the extent of left hand travel of the sliding member 3, as shown in FIGS. 2 and 3. The slide member 3 is also guided for longitudinal movement within the housing chamber 4*a* by a horizontal guide rib 23 provided on the side wall 24 of the electrical contact 2. As shown in FIG. 3, the bridge portion 13 that connects the clamping leg 14 with the base portion 12 of the clamping spring 1 contains a slot 13*a* that slidably receives the slide member 3.

Referring now to FIGS. 1 and 4, the stop member 45 cooperates with the top wall 4*b* of the housing chamber 4*a* to define an opening 60 for receiving the bare end of the conductor 6 that is introduced within the chamber 4*a*, as shown in FIG. 6.

Referring to FIGS. 3 and 4, it is to be noted that the restoring leg 10 of the clamping spring is biased to the left to engage the adjacent extremity 34 of the slide member 3, thereby to bias the slide member 3 to the left toward its illustrated released position. Similarly, the clamping leg 14 is resiliently biased toward an extended condition relative to the spring base portion 12, thereby to cause the tip 15 of the clamping leg 14 to engage the undersurface of the upper flange 23 of the electrical contact 2.

In operation, in order to insert the conductor 6 within the housing chamber 4*a* for electrical engagement with the upper flange portion 23 of the electrical contact 2, the slide member 3 is manually displaced to the right against the restoring force of resilient restoring leg 10, thereby to compress the leg 10 relative to the intermediate leg 11. Lateral projection 33 engages the adjacent surface of the clamping leg 14, thereby to displace clamping leg 14 in the clockwise direction relative to the stationary base portion 12, and to remove the obstruction provided by the clamping leg 14 to the insertion of the conductor 6. After the conductor is fully inserted within the chamber 4*a*, the pressing force on the slide member 3 is removed, and the clamping leg 14 expands relative to the base portion thereby to cause the locking tip of the clamping leg 14 to dig into the adjacent surface of the conductor 6, whereby the conductor is retained in lateral conductive engagement with the upper flange portion 23 of the electric contact 2. The conductor may now be connected with a pin contact inserted between the legs 21 of the female contact of the end of the contact member 2, as is known in the art.

Figure 8:
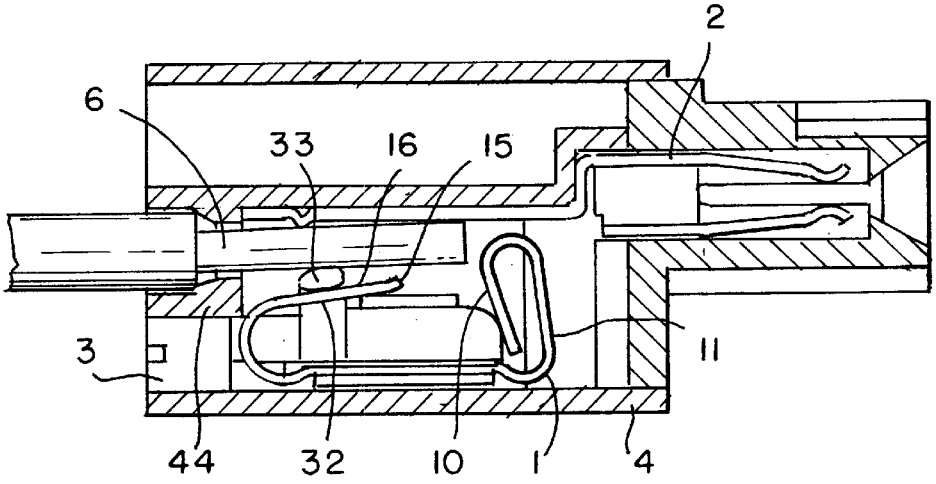
FIG. 8 illustrates the connector of FIG. 6 when the slide member is inserted to place the connector in the unlocked condition.

In order to remove the conductor from the housing chamber 4*a*, the user merely manually displaces the slide member 3 to the right toward a fully inserted position (FIG. 8) against the return force of the restoring leg 10, thereby to cause the lateral projection 33 to engage clamping leg 14 to pivot the same downwardly toward the base portion 12, whereby the tip portion 15 of the clamping leg is released from the bare conductor portion of the conductor 6. The conductor 6 may now be displaced to the left for removal from the housing chamber 4*a*, thereby to interrupt the electrical engagement between the bare conductor 6 and the upper contact flange 23.

Of course, instead of the female contact elements 21 at the right hand end of the electrical contact 2, a single plug contact might be provided for connection with a female contact, not shown.

As shown from the top plan view in FIG. 5, the housing 4 could be provided with a plurality of chambers 4*a* for receiving separate assemblies each including a clamping spring 1, an electrical contact 2, and a slide element 3. As shown in FIG. 6, the contact body may be provided with a flat portion by means of which the electrical contact may be soldered or spot welded to a further contact.

Figure 7:
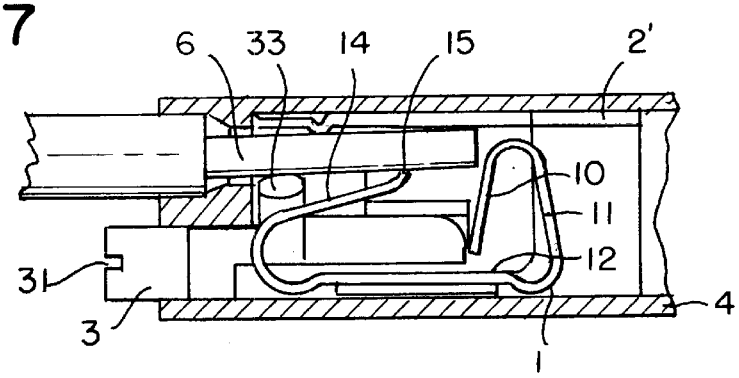
FIG. 7 is a sectional view of the connector of FIG. 6 with the conductor in its fully inserted position.

Referring to FIG. 7, it will be seen that when the conductor 6 is in its fully inserted position, the tip 15 of the clamping leg 14 is in engagement with the conductor 6, and the resilient restoring leg 10 biases the slide member 3 to the left toward its initial released position, as shown. In order to release the conductor 6 for removal from the chamber 4*a*, the slide member 3 is again inserted to the right against the restoring force of the restoring leg 10, whereupon the projection 33 engages the clamping leg 14 to displace the same downwardly toward the base portion 12, whereupon the conductor 6 may be readily withdrawn from the housing chamber, thereby to disengage the electrical contact between the conductor and the electrical contact 2.

Figure 9:
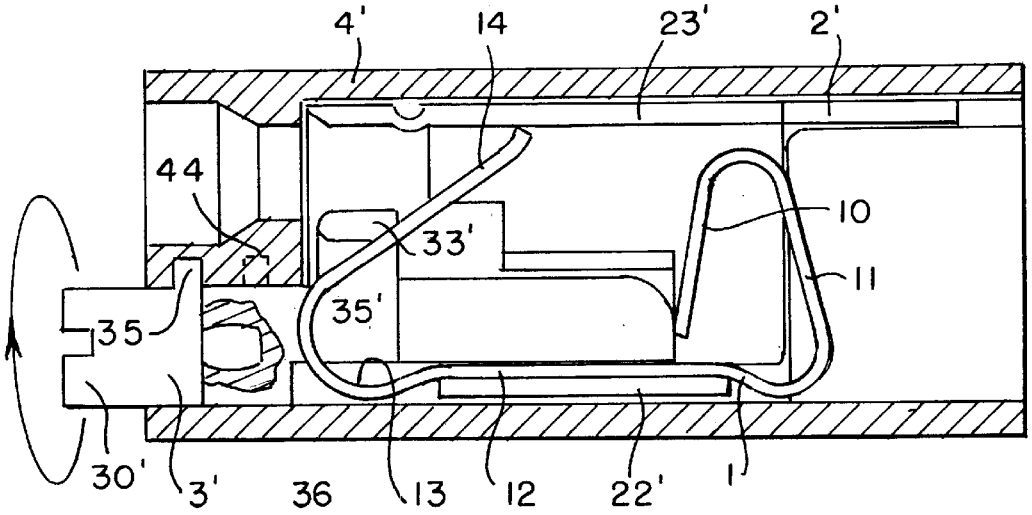
FIG. 9 is a sectional view of a modification of the invention including latch means for latching the slide member in one of its inserted and released positions, respectively.

It is possible to lock the slide member 3 in either its inserted or released positions, as desired. To this end, in the embodiment of FIG. 9, the enlarged head portioned 30 prime is rotatably connected with the remaining body portion of the slide member 3, the head portion containing a latch projection 35 that extends within the corresponding keeper portion formed within the stop portion 45 of the housing 4 prime. In this embodiment, the enlarged head portion 30' is provided with a central peg portion 36 that extends within a corresponding recess contained in the slide member 3, thereby to permit rotation of the enlarged head portion 30' to remove the latch 35 from its corresponding keeper recess. Similarly, the enlarged head portion 30 prime could be connected with the body portion of the sliding member by conventional bayonet type fittings or the like. As shown in phantom, the sliding member may be locked in its inserted position 35'.

Figure 10:
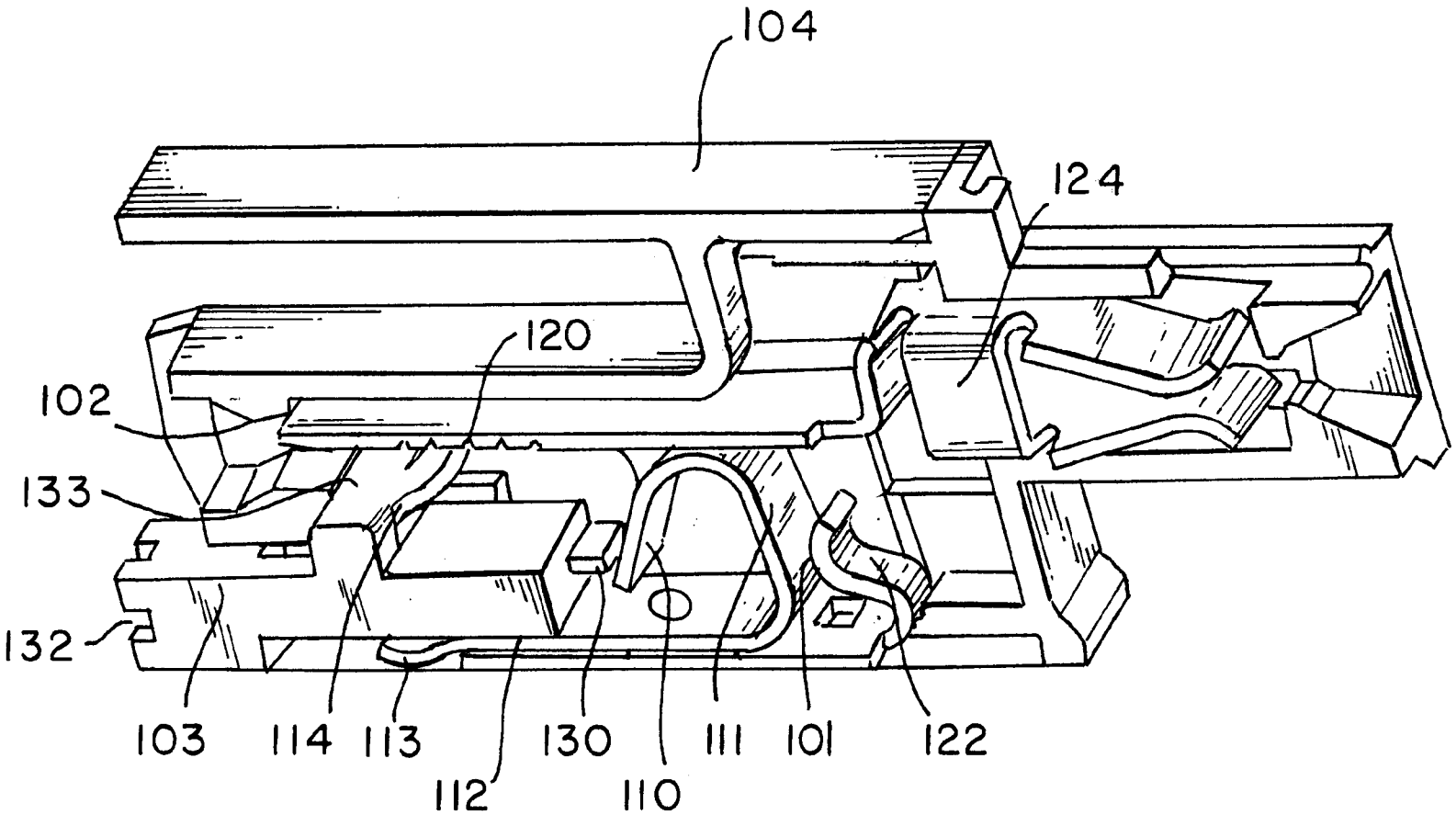
FIG. 10 is a perspective view of a modification of the screwless terminal connector of FIG. 6.

Referring now to FIG. 10, in this embodiment the clamping spring 101 is arranged between the flange portions of the stationary electrical contact 102, and is in embodying engagement with the end stop portion 122 of the contact member. In this embodiment, the lower surface of the upper flange portion 123 is provided with a plurality of the longitudinally spaced grooves 120 that selectively receive the tip portion of the clamping leg 114. As before, the housing sections 104 and 105 are formed of a suitable non-conductive synthetic plastic insulating material. As before, shifting of the slide member 132 to the right causes axial projection 130 to engage the resilient restoring leg 110, and the projecting portion 133 causes clamping leg 114 to be pivoted to the right in the clockwise direction toward a spaced position relative to the upper contact flange, thereby to permit insertion of the bare conductor end within the opening 160.

As before, the base portion 112 of the resilient clamping spring 101 is supported by the lower flange portion of the electrical contact 102. In this embodiment, the slide element 103 has a shortened version and includes a tapered tip 130 that engages the resilient restoring leg 110. At its other end, the sliding element 103 contains a slot 132 for receiving the associated tip of an actuating tool, such as a screwdriver.

While in accordance with the provisions of the Patent Statutes the preferred form and embodiment of the invention have been illustrated and described, it will be apparent to those skilled in the art that various changes may be made without deviating from the inventive concepts set forth above.

What is claimed is:

1. A screwless terminal connector operable to connect an electrical conductor to a conductive contact, comprising:

(a) a housing (4) formed of non-conductive insulating material, said housing containing a longitudinally-extending chamber **(4*a*)**;

(b) a stationary electrical contact (2) mounted in fixed longitudinally-extending relation within said housing chamber;

(c) a clamping spring (1) mounted in fixed longitudinally-extending relation within said housing chamber adjacent said contact, said spring including:

(1) a base portion (12) extending longitudinally within said housing chamber in spaced relation to said electrical contact, said base portion having first and second ends;

(2) a reversely-bent clamping leg portion (14) connected at an acute angle relative to said base portion first end, said clamping leg portion being normally biased in the direction of said contact toward an engaged position relative to said base portion;

(d) a slide member (3) mounted longitudinally in housing chamber adjacent said clamping spring base portion one end, said slide member being longitudinally displaceable between released and inserted positions relative to said clamping spring base portion, said slide member in said inserted portion being operable to bend said clamping leg away from said electrical contact toward a disengaged position relative to said contact, thereby to permit introduction of the conductor between said clamping leg and said contact; and (e) restoring means resiliently biasing said slide member toward said released position, said restoring means being integral with said clamping spring and including a resilient restoring leg (10) connected with said base portion second end, said restoring leg being biased in the direction of said base portion first end toward a normal expanded position, said restoring leg being arranged for displacement by said slide member toward said disengaged position when said slide member is in said inserted position.

2. A screwless connector as defined in claim 1, and further including latch means (35) for locking said slide member in said inserted position.

3. A screwless connector as defined in claim 1, and further including latch means (35) for retaining said slide member is at least one of said released and inserted positions.

4. A screwless connector as defined in claim 1, and further including stop means (45) preventing withdrawal of said slide member from said housing chamber.

5. A screwless terminal as defined in claim 1, wherein said restoring leg is arranged for engagement by the associated end extremity (34) of said slide member.

6. A screwless terminal as defined in claim 1, wherein said clamping spring further includes an intermediate portion (11) connecting said restoring leg with said base portion, said intermediate portion being generally normal to said base portion, and arranged at an acute angle relative to said restoring leg.

7. A screwless terminal as defined in claim 1, wherein said clamping leg is connected with said clamping spring base portion by a connecting portion (13) containing a slot that receives said sliding member.

8. A screwless terminal as defined in claim 1, wherein said electrical contact includes a support portion (22) that supports said clamping spring base portion.

9. A screwless terminal as defined in claim 1, wherein said housing contains a plurality of chambers receiving a plurality of said clamping springs and said slide members, respectively.

10. A screwless terminal as defined in claim 1, wherein said electrical contact is a female type including a pair of spaced resilient arms.

11. A screwless terminal as defined in claim 1, wherein said electrical contact is a male pin contact.

12. A screwless terminal connector is defined in claim 8, wherein said electrical connector includes a contact portion (23) parallel with and spaced from said support portion, said clamping spring being arranged between said electrical support and contact portions, said clamping leg being biased toward said contact portion.

* * * * *